US008506320B1

(12) United States Patent
Fu et al.

(10) Patent No.: US 8,506,320 B1
(45) Date of Patent: Aug. 13, 2013

(54) MOUNTING APPARATUS FOR FLASH DRIVE

(75) Inventors: Li-Ren Fu, Shenzhen (CN); Zheng-Heng Sun, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 51 days.

(21) Appl. No.: 13/400,139

(22) Filed: Feb. 20, 2012

(30) Foreign Application Priority Data

Jan. 30, 2012 (CN) ..... 2012 1 0020880

(51) Int. Cl.
*H01R 13/62* (2006.01)

(52) U.S. Cl.
USPC ..... 439/367; 439/369; 361/679.4

(58) Field of Classification Search
USPC ..... 439/527, 367, 369, 372, 374; 361/679.4
See application file for complete search history.

(56) References Cited

U.S. PATENT DOCUMENTS

| | | | | |
|---|---|---|---|---|
| 7,927,126 | B1 * | 4/2011 | Bender | 439/369 |
| 8,052,455 | B1 * | 11/2011 | Peng et al. | 439/353 |
| 8,100,710 | B1 * | 1/2012 | Peng et al. | 439/369 |
| 2009/0149055 | A1 * | 6/2009 | Uchikawa et al. | 439/367 |
| 2011/0228462 | A1 * | 9/2011 | Dang | 361/679.4 |
| 2012/0147540 | A1 * | 6/2012 | Peng et al. | 361/679.4 |
| 2013/0003289 | A1 * | 1/2013 | Sun | 361/679.33 |

* cited by examiner

*Primary Examiner* — Hae Moon Hyeon
(74) *Attorney, Agent, or Firm* — Altis Law Group, Inc.

(57) ABSTRACT

A mounting apparatus is used to fix a flash drive mounted on a circuit board with a connector. The mounting apparatus receives the flash drive and connector. The mounting apparatus includes a base board, and a first sidewall and a second sidewall opposite to each other. An operation portion extends from an end of the base board opposite to the circuit board and forms a blocking portion on a front surface to block a top of the flash drive. Two pairs of fixing portions are formed on the mounting apparatus, respectively for perpendicularly and horizontally mounting the mounting apparatus to the circuit board.

7 Claims, 4 Drawing Sheets

MOUNTING APPARATUS FOR FLASH DRIVE

CROSS-REFERENCE OF RELATED APPLICATION

Relevant subject matter is disclosed in a pending U.S. patent application, titled "MOUNTING APPARATUS FOR FLASH DRIVE", filed on Dec. 27, 2011, with the application Ser. No. 13/337,316, which is assigned to the same assignee as this patent application.

BACKGROUND

1. Technical Field

The present disclosure relates to an apparatus for mounting a flash drive.

2. Description of Related Art

In some computers, programs for driving elements mounted on the circuit boards are stored in flash drives, such as universal serial bus (USB) flash drives, which are detachable from the computers. However, the USB flash drives are generally engaged with connectors of the computers directly. As a result, the USB flash drives may easily disengage from the corresponding connectors after impact and vibration of the computers or the USB flash drives.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
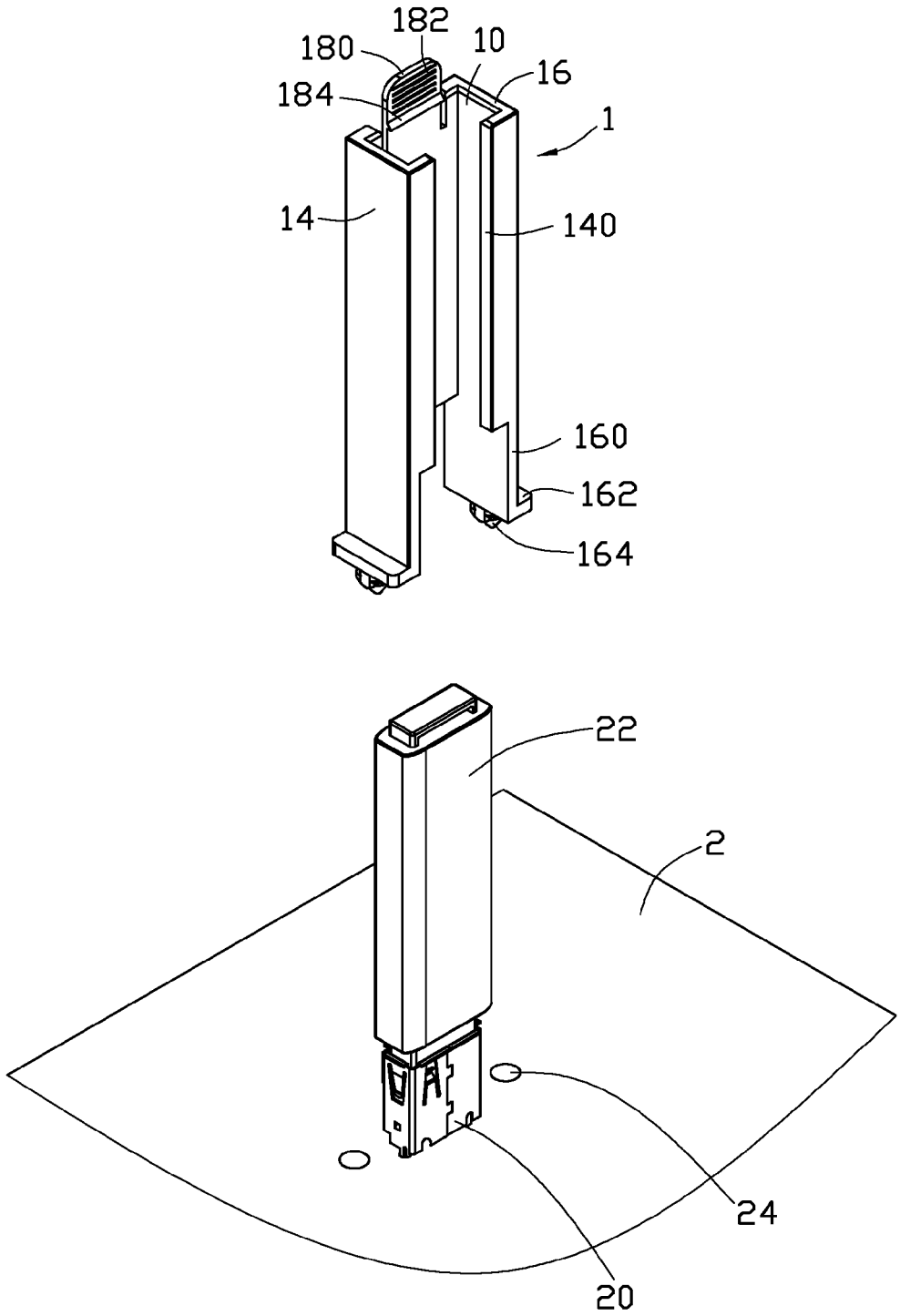
FIG. 1 is an exploded, isometric view of an exemplary embodiment of a mounting apparatus, together with a universal serial bus (USB) flash drive.
Figure 2:
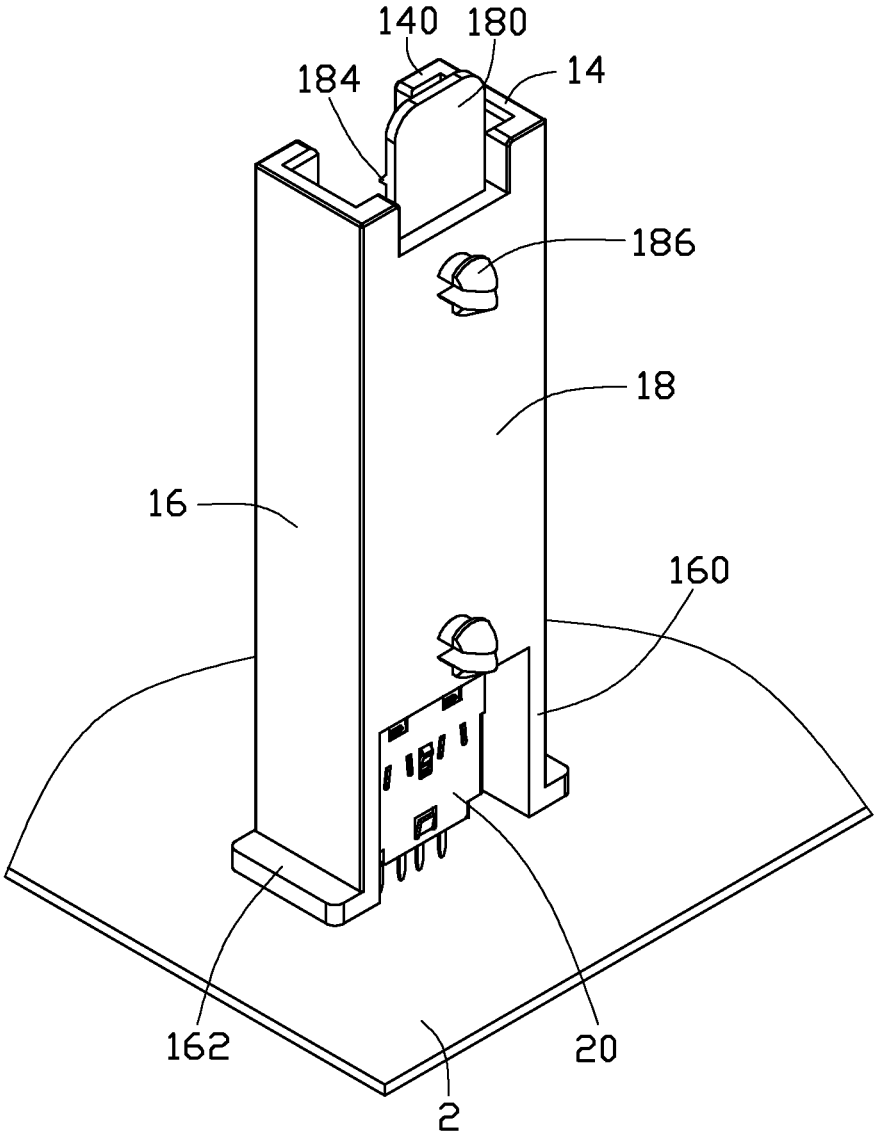
FIG. 2 is a partially assembled view of FIG. 1, but viewed from another perspective.

FIGS. 1 and 2, show an exemplary embodiment of a mounting apparatus 1 used to fix a flash drive, such as a universal serial bus (USB) flash drive 22, which is engaged with a connector 20 mounted on a circuit board 2.

The mounting apparatus 1 is hollow and substantially rectangular cube shaped, and defines a receiving space 10 therein. The mounting apparatus 1 includes a first sidewall 14, a second sidewall 16 opposite to the first sidewall 14, and a base board 18 perpendicularly connected between first sides of the first and second sidewalls 14 and 16. Two front walls 140 perpendicularly extend toward each other, from second sides of the first and second sidewalls 14 and 16 opposite to the base board 18. An L-shaped leg 160 extends down from a bottom end of each of the first and second sidewalls 14 and 16, and then extends out to form a tab 162. A deformable fixing portion 164 extends from a bottom surface of each tab 162. An operation portion 180 extends up from a top end of the base board 18. An antiskid portion 182 is formed on a front surface of the operation portion 180 facing the front walls 140, for conveniently operating the operation portion 180. A blocking portion 184 protrudes from the front surface of the operation portion 180, below the antiskid portion 182. Two deformable fixing portions 186 extend out from the rear surface of the base board 18 opposite to the front surface. Each of the fixing portions 164 and 186 has a tapered distal end.

The circuit board 2 defines two fixing holes 24 at opposite sides of the connector 20, respectively.

In assembling of the mounting apparatus 1 to the circuit board 2, the fixing portions 164 of the first and second sidewalls 14 and 16 are deformed to extend through the corresponding fixing holes 24, and then are blocked by a bottom surface of the circuit board 2, to perpendicularly mount the mounting apparatus 1 to the circuit board 2. The connector 20 is sandwiched between the legs 160.

Figure 3:
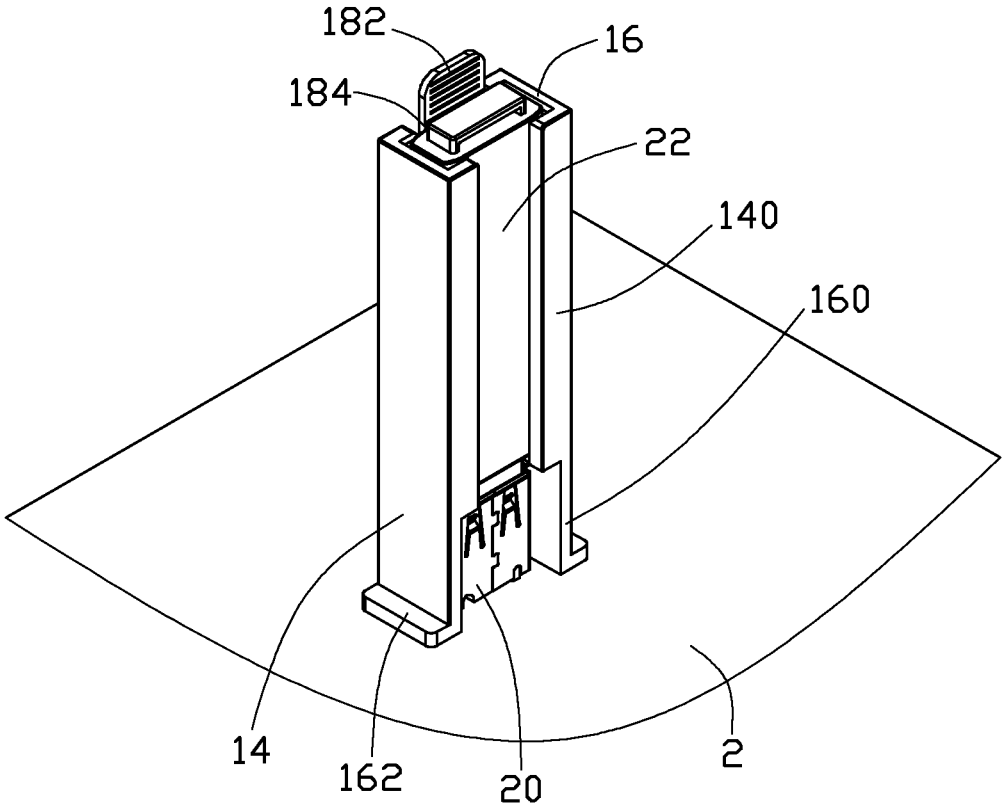
FIG. 3 is an assembled, isometric view of the mounting apparatus and the USB flash drive of FIG. 1.

Referring to FIG. 3, in use, the operation portion 180 is deformed rearward. The USB flash drive 22 is received in the receiving space 10 and inserted into the connector 20. The operation portion 180 is then self-restored, to push the blocking portion 184 to block a top of the flash drive 22.

In disassembling the USB flash drive 22, the operation portion 180 is pivoted rearward again, to disengage the blocking portion 180 from the top of the flash drive 22. Thereby, the flash drive 22 is ready for being disengaging from the connector 20.

Figure 4:
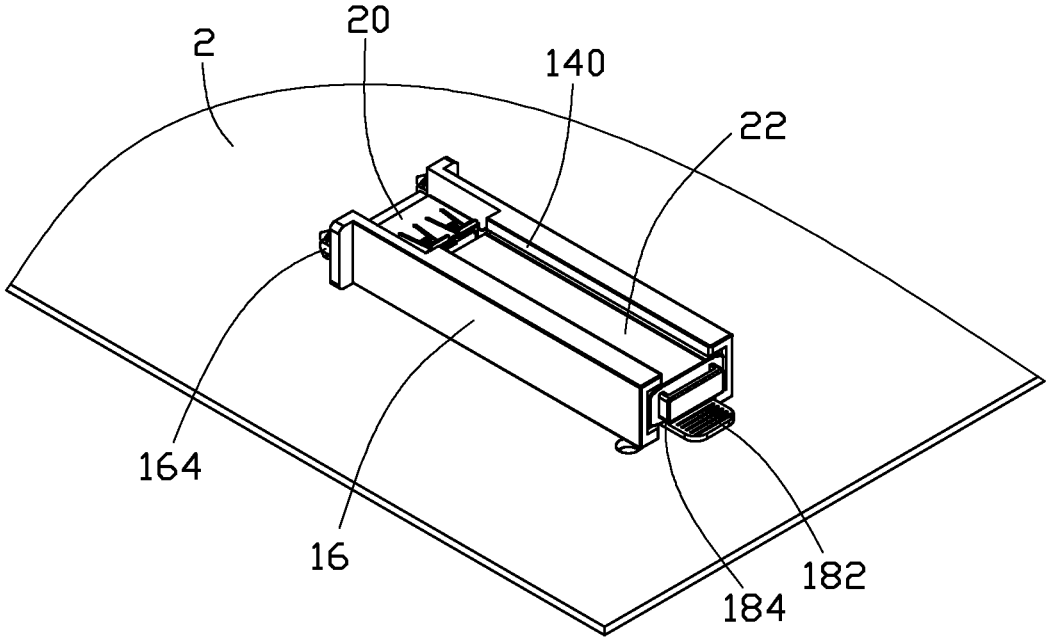
FIG. 4 is an assembled view of the mounting apparatus of FIG. 1 horizontally mounted on a circuit board to hold a flash drive on the circuit board.

Referring to FIG. 4, in another embodiment, the connector 20 is horizontally installed on the circuit board 2, and the circuit board 2 defines two fixing holes (not shown) in alignment with the connector 20. The fixing portions 186 are extended through the corresponding fixing holes, and then are blocked by the bottom surface of the circuit board 2, to horizontally mount the mounting apparatus 1 to the circuit board 2. The connector 20 is sandwiched between the legs 160.

It is believed that the present embodiments and their advantages will be understood from the foregoing description, and they will be apparent that various changes may be made thereto without departing from the spirit and scope of the description or sacrificing all of their material advantages, the examples hereinbefore described merely being exemplary embodiment.

What is claimed is:

1. A mounting apparatus for fixing a flash drive to a connector of a circuit board, the mounting apparatus comprising:

a base board forming a deformable operation portion at an end, the operation portion forming a blocking portion on a front surface to block a top of the flash drive;

a first sidewall extending out from one of opposite sides of the base board;

a second sidewall extending out from the other one of the opposite sides of the base board to sandwich the flash drive together with the first sidewall;

two first fixing portions configured for perpendicularly mounting the mounting apparatus to the circuit board; and two second fixing portions configured for horizontally mounting the mounting apparatus to the circuit board.

2. The mounting apparatus of claim 1, wherein two front walls extend toward each other respectively from sides of the first and second sidewalls opposite to the base board, to sandwich the flash drive together with the base board.

3. The mounting apparatus of claim 1, wherein each of the first and second fixing portions has a deformable tapered distal end to be extended through the circuit board and blocked by a bottom surface of the circuit board.

4. The mounting apparatus of claim 3, wherein the first fixing portions respectively extend down from ends of the first and second sidewalls opposite to the operation portion.

5. The mounting apparatus of claim 4, wherein the second fixing portions extend from a rear surface of the base board opposite to the first and second sidewalls.

6. The mounting apparatus of claim 4, wherein an L-shaped leg extend down from an end of each of the first and second sidewalls opposite to the operation portion, and then extends out to form a tab, the first fixing portions respectively extend down from the tabs away from the operation portion.

7. The mounting apparatus of claim 1, wherein an antiskid portion is formed on a front surface of the operation portion, above the blocking portion.

* * * * *